US008641377B1

(12) United States Patent
Liang

(10) Patent No.: US 8,641,377 B1
(45) Date of Patent: Feb. 4, 2014

(54) INDUSTRIAL TURBINE BLADE WITH PLATFORM COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 562 days.

(21) Appl. No.: 13/032,965

(22) Filed: Feb. 23, 2011

(51) Int. Cl.
*F01D 5/08* (2006.01)
*F01D 5/30* (2006.01)
*F01D 11/00* (2006.01)

(52) U.S. Cl.
USPC ..... 416/96 R; 416/193 A

(58) Field of Classification Search
USPC ..... 415/1, 115, 116; 416/1, 95, 96 A, 96 R, 416/97 A, 97 R, 193 A
See application file for complete search history.

(56) References Cited

U.S. PATENT DOCUMENTS

| | | | | |
|---|---|---|---|---|
| 6,190,130 | B1 * | 2/2001 | Fukue et al. | 416/97 R |
| 7,695,247 | B1 * | 4/2010 | Liang | 416/97 R |
| 8,511,995 | B1 * | 8/2013 | Liang | 416/97 R |
| 2006/0269409 | A1 * | 11/2006 | Torii et al. | 416/97 R |

* cited by examiner

*Primary Examiner* — Nathaniel Wiehe
*Assistant Examiner* — Su Htay
(74) *Attorney, Agent, or Firm* — John Ryznic

(57) ABSTRACT

A turbine rotor blade for an industrial gas turbine engine with a platform cooling circuit that flows from the suction side of the platform and around both the leading edge and trailing edge of the platform, and then along the pressure side platform to cover the entire platform surface. The cooling air flows along smaller diameter cooling holes that cover substantially the entire pressure side platform surface and is then discharged out through openings onto the pressure side mateface.

8 Claims, 5 Drawing Sheets

INDUSTRIAL TURBINE BLADE WITH PLATFORM COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an industrial gas turbine engine turbine blade with platform cooling.

2. Description of the Related Art including information disclosed under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The cooling of the blade platform in an industrial gas turbine engine is produced using convection cooling or film cooling. In the convection cooled platform, straight cooling holes formed within the platform with long length-to-diameter ratios are used. FIGS. 1 and 2 show this prior art blade platform cooling design using film cooling holes. FIGS. 3 and 4 show the prior art blade platform cooling design using convection cooling holes. The blade includes an airfoil section extending from a platform 12 and a root section 13 with a cooling air supply channel 16. In FIG. 2, the platform is cooled using a number of film cooling holes 15 connected to a dead rim cavity 14 formed below the platform 12. In FIG. 4, the platform convection cooling holes 16 are supplied from the cooling air supply channel 17.

The blade platform cooling designs of FIGS. 1 through 4 have several important design issues. Providing film cooling air for the entire blade platform requires a cooling air supply pressure from the dead rim cavity 14 to be higher than the peak blade platform external gas side pressure. This design induces a high leakage flow around the blade attachment region 13 and therefore causes a performance penalty. Using the long length-to-diameter ratio convection cooling holes that are drilled from the platform edge to the airfoil cooling supply channel 16 from the blade platform produces unacceptable stress levels at the airfoil cooling core and the platform cooling channels interface location, which therefore yields a low blade life. This problem is primary due to the large mass at the front and back ends of the blade root or attachment 13 which constrains the blade platform expansion. The cooling channels are also oriented transverse to the primary direction of the stress field which produces high stress concentrations in the cooling channels at the entrance location.

An inspection of these prior art turbine rotor blades indicates that an over-temperature occurs at the blade platform pressure side location and the aft portion of the suction side platform edge and the aft section of the suction side platform to airfoil transition location. To address this over-temperature problem, the blade platform cooling circuit of FIG. 5 was proposed. FIG. 5 shows three convection cooling channels 23 with long length-to-diameter ratios that are parallel to the platform to cool the platform pressure side surface and a large diameter cooling channel 21 with three smaller channels 22 that branch off to cool the platform suction side surface. Cooling air form the four larger diameter cooling channels 21 and 23 are supplied from a front end of the platform from the dead rim cavity below the platform and then discharged at the aft face of the platform into a gap formed between adjacent platform edges.

In some turbine blade, the airfoil suction side surface is positioned very close to the mate-face of the platform and thus not enough space is available for a cooling air channel to extend from the leading edge to the trailing edge of the platform. Also, a long and straight cooling channel used on the pressure side of the platform cannot provide sufficient cooling for the platform hot spot locations.

BRIEF SUMMARY OF THE INVENTION

An improvement over the prior art blade platform cooling circuits can be made by incorporating the new and effective counter flowing cooling channels into the blade pressure and suction side platforms. The counter flowing cooling channels are constructed with multiple feed channels that start on the platform suction side and wrap around the airfoil leading edge trailing edges. Multiple cooling channels are located across the platform pressure side that connect to the wrap around supply channels and discharge cooling air along the pressure side mate-face for cooling and sealing.

Cooling air from the dead rim cavity flows through a number of cooling air supply holes and into the feed holes along the leading edge and trailing edge sides of the suction side of the platform and into a forward cooling channel along the leading edge side and an aft cooling channel along the trailing edge side of the platform. the cooling air then flows through cooling channels on the pressure side of the platform as close to the contour of the pressure side airfoil as possible, and then through multiple rows of cooling channels along the remaining surface of the pressure side platform before discharging onto the pressure side mate-face.

DETAILED DESCRIPTION OF THE INVENTION

Figure 1:
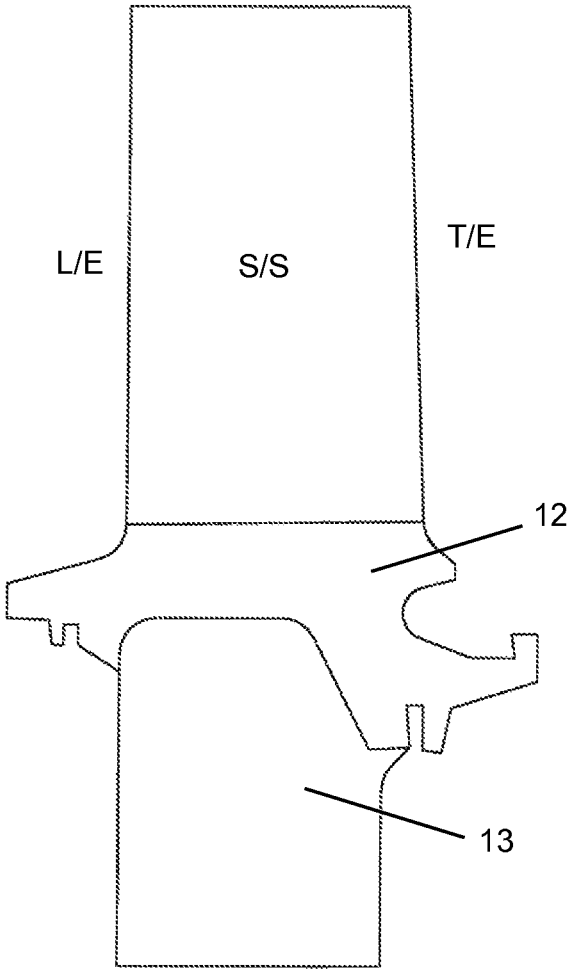
FIG 1 prior art
FIG. 1 shows a side view from the suction side of a prior art turbine blade with film cooling holes on the platform.
Figure 2:
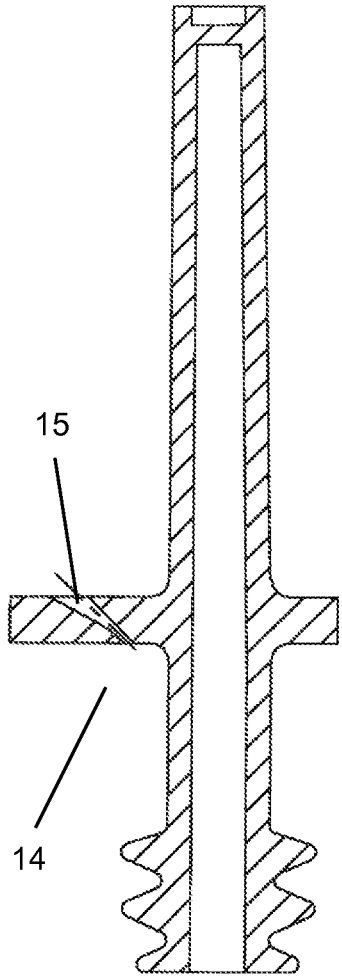
FIG 2 prior art
FIG. 2 shows a cross section view of the prior art turbine rotor blade of FIG. 1.
Figure 3:
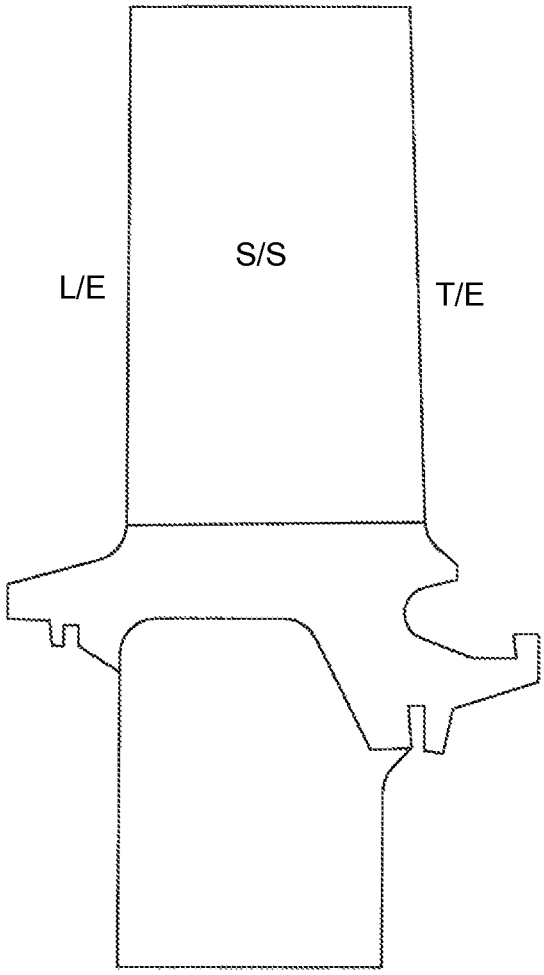
FIG 3 prior art
FIG. 3 shows a side view from the suction side of a prior art turbine blade with convection cooling holes in the platform.
Figure 4:
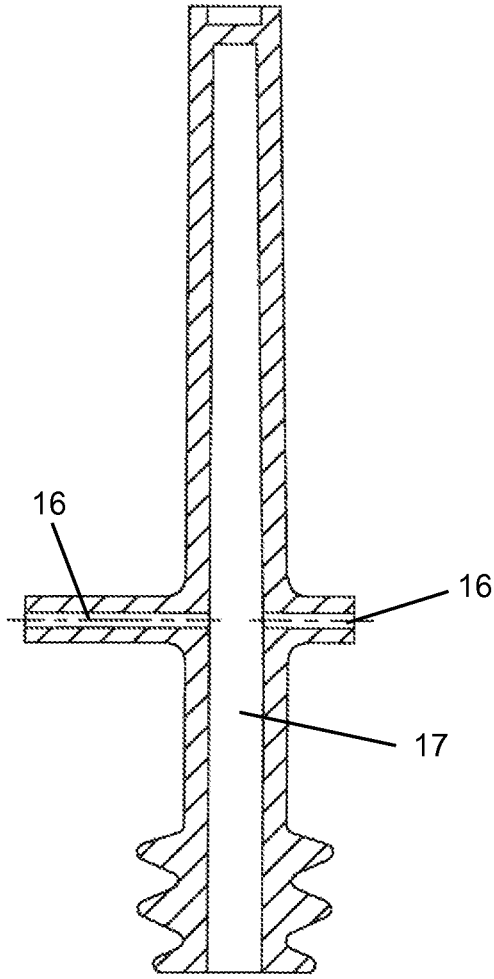
FIG 4 prior art
FIG. 4 shows a cross section view of the prior art turbine rotor blade of FIG. 3.
Figure 5:
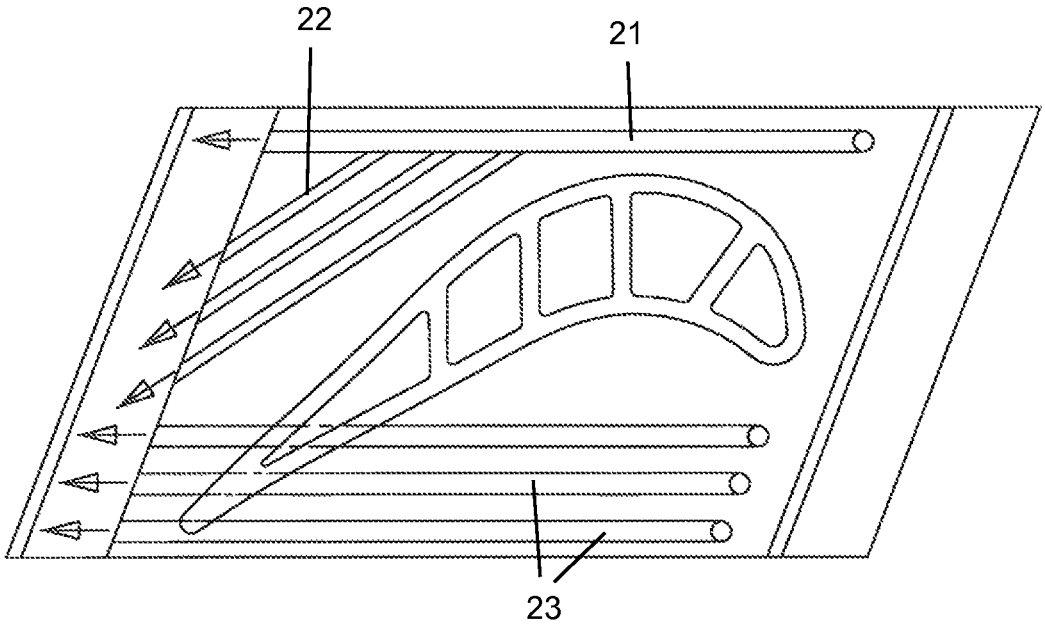
FIG 5 prior art
FIG. 5 shows a cross section top view of a prior art first stage industrial engine turbine rotor blade with a platform cooling circuit.
Figure 6:
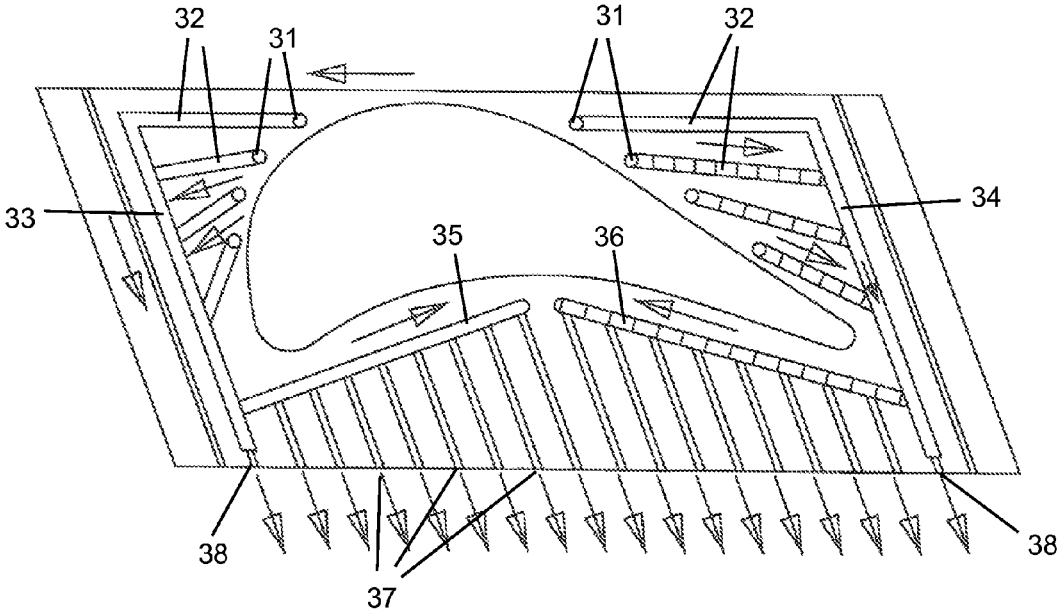
FIG. 6 shows a cross section top view of the platform cooling circuit of the present invention.

The turbine rotor blade with the platform cooling circuit of the present invention is intended for use in a large frame heavy duty industrial gas turbine engine for the first stage blades. However, the platform cooling circuit could be used for other turbines in which higher turbine inlet temperatures are required. FIG. 6 shows a top view of the platform cooling circuit in which the airfoil on the suction side is located too close to the edge of the platform to pass a cooling channel along that edge. Several suction side feed holes 32 are located on the leading edge side and the trailing edge side of the platform each connected to a cooling air supply hole 31 that opens into the dead rim cavity located below the platform. The feed holes 32 are located strategically on the suction side of the platform to provide enough cooling for this surface of the platform.

All of the cooling feed holes 32 discharge into a cooling channel (33, 34) located along the leading edge side or the trailing edge side of the platform and extend from the suction side edge to the pressure side edge of the platform. The leading edge side cooling channel 33 and the trailing edge side cooling channel 34 both flow out the pressure side mate-face with a restricted opening 38 so that enough pressure is produced within the channels so that the cooling air will flow into the channels or holes on the pressure side platform surface. A leading edge pressure side cooling channel 35 is connected to the leading edge side cooling channel 33 and the trailing edge pressure side cooling channel 36 is connected to the trailing edge side cooling channel 34. The two pressure side cooling channels 35 and 36 follow a contour of the pressure side airfoil so that as much of the pressure side of the platform is covered with cooling air channels or holes.

Figure 7:
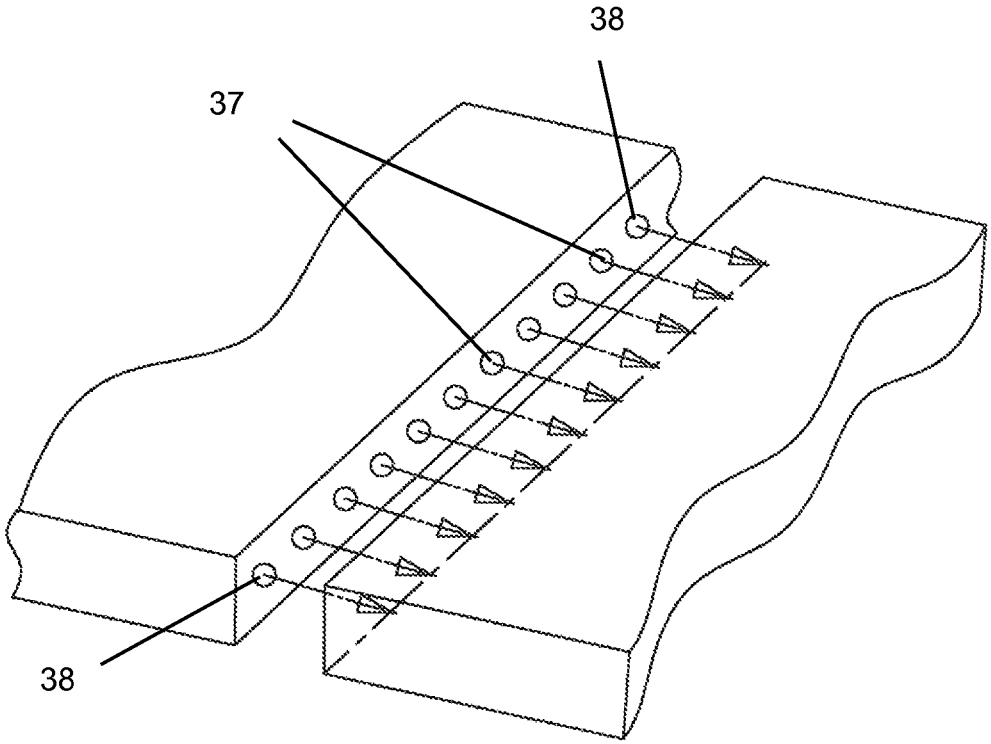
FIG. 7 shows an isometric view of the pressure side mate-face of the platform of FIG. 6 with a row of cooling channels opening onto the mate-face.

A number of smaller cooling air channels 37 are connected to each of the two pressure side cooling channels 35 and 36 to cool as much of the pressure side platform surface as possible using convection cooling. The smaller cooling air channels 37 all discharge out the pressure side mate-face and form a seal against the adjacent platform mate-face. FIG. 7 shows an isometric view of the pressure side mate-face with the rows of smaller cooling air channels 37 and the restricted openings 38 opening onto the surface.

The platform cooling circuit of the present invention includes two separate platform cooling circuits that are in parallel from the dead rim cavity to the pressure side mate-face. The leading edge platform cooling circuit is symmetric to the trailing edge platform cooling circuit in that each includes a number of cooling air feed holes opening into cooling holes on the suction side of the platform, then flows into the longer cooling hole along the leading edge and trailing edge sides, and then into the pressure side larger cooling hole that opens into the smaller diameter cooling holes on the pressure side of the platform, and then discharge out through the openings on the pressure side mate-face. Thus, one of the two platform cooling circuits flows from the suction side, wraps around the leading edge and then flows into the pressure side of the platform. The other flows from the suction side, wraps around the trailing edge and then flows into the pressure side of the platform.

In operation, cooling air is supplied from the dead rim cavity and into the multiple cooling channels at the blade platform suction side. For the forward end of the suction side platform, cooling is channeled forward toward the platform leading edge. The spent cooling air is then discharged into a cross platform transfer channel that passes the cooling air from the suction side to the pressure side of the platform. The cooling air from the two transport channels the flows into two cooling channels having a long length-to-diameter ratio on the pressure side platform for additional convection cooling. The cooling air then flows through smaller diameter cooling channels spaced over the pressure side platform surface to provide convection cooling for the platform pressure side surface and then discharged out onto the pressure side mate-face for sealing purposes.

In the platform cooling circuit of the present invention, the convection cooling surfaces on the platform are maximized for both the pressure side and the suction side. Any hot spot on the platform pressure or suction side will be covered by the counter flowing convection cooling channels. Also, trip strips can be used within the cooling channels of the larger diameter at any hot spot location to further enhance the internal heat transfer performance. As seen in FIG. 6, trip strips are located in the channels 32 and 36 that are located in the trailing edge side of the platform and close to the airfoil where hot spots are found in this rotor blade.

Since all of the spent cooling air is discharged onto the platform pressure side only, there is no issue for the spent cooling air discharge hole misalignment or discharge jet interaction. Thus, multiple long cooling channels at smaller diameter size hole can be used on the platform pressure side and a smaller diameter cooling channel is used along the counter convection cooling channel to induce more convection cooling surface for cooling of the blade pressure side surface and also to discharge the spent cooling air in a more uniform manner along the mate-face. This design allows for discharging the cooling air through multiple holes to impinge on to the adjacent platform mate-face and form an air curtain to prevent hot gas ingestion into the mate-face gap.

As a result of the platform cooling circuit of the present invention, the airfoil pressure side and suction side platform surfaces can be cooled using multiple counter flowing circuits with long length-to-diameter convection cooling channels. Any hot spot location which is not covered by the straight cooling holes will be cooled by the slanted cooling channels. Also, the airfoil mate-face is cooled by the combination of both film cooling and convection cooling. The mate-face gap is sealed by the air cushion that develops from the discharging of the cooling air which doubles the use of the cooling air to improve the over-all blade platform cooling efficiency and reduces the blade platform metal temperature, which will allow for a longer blade life.

I claim the following:

1. An industrial engine turbine rotor blade comprising:

an airfoil extending from a platform;

the platform having a leading edge side and a trailing edge side and a suction side and a pressure side;

a plurality of leading edge side cooling air supply holes on the suction side of the platform and connected to a dead rim cavity;

a plurality of trailing edge side cooling air supply holes on the suction side of the platform and connected to the dead rim cavity;

the leading edge side cooling air supply holes are each connected to a leading edge suction side cooling hole formed within the platform;

the trailing edge side cooling air supply holes are each connected to a trailing edge suction side cooling hole formed within the platform;

a leading edge side cooling channel extending along substantially an entire length of the leading edge side of the platform;

a trailing edge side cooling channel extending along substantially an entire length of the trailing edge side of the platform;

the leading edge suction side cooling holes open into the leading edge side cooling channel;

the trailing edge suction side cooling holes open into the trailing edge side cooling channel;

a leading edge pressure side cooling channel formed within the platform and connected to the leading edge side cooling channel;

a trailing edge pressure side cooling channel formed within the platform and connected to the trailing edge side cooling channel;

the leading edge pressure side cooling channel and the trailing edge pressure side cooling channel both follow a contour of the pressure side airfoil;

a row of smaller diameter cooling holes formed within the platform and connected to the leading edge pressure side cooling channel and the trailing edge pressure side cooling channel; and the row of smaller diameter cooling holes open onto a pressure side mate-face of the platform and extend from the leading edge pressure side cooling channel to the trailing edge pressure side cooling channel.

2. The industrial engine turbine rotor blade of claim 1, and further comprising:

the row of smaller diameter cooling holes is all parallel to one another.

3. The industrial engine turbine rotor blade of claim 1, and further comprising:

the leading edge side cooling channel and the trailing edge side cooling channel both open onto the pressure side mate-face of the platform with a restricted opening.

4. The industrial engine turbine rotor blade of claim 1, and further comprising:

trip strips are located within a larger diameter cooling channel formed within the platform at a location of a hot spot on the platform surface in order to enhance an internal heat transfer coefficient.

5. The industrial engine turbine rotor blade of claim 1, and further comprising:

the leading edge suction side cooling holes and the trailing edge suction side cooling holes and the leading edge pressure side cooling channel and the trailing edge pressure side cooling channel and the row of smaller diameter cooling holes all together cover substantially the entire platform surface of the blade.

6. The industrial engine turbine rotor blade of claim 1, and further comprising:

all of the cooling air that flows into the plurality of leading and trailing edge side cooling air supply holes is discharged out through the leading edge pressure side cooling channel and the trailing edge pressure side cooling channel and the row of smaller diameter cooling holes.

7. The industrial engine turbine rotor blade of claim 1, and further comprising:

trip strips are located in some of the cooling channels where hot spots are found.

8. A process for cooling a platform of an industrial engine turbine rotor blade comprising the steps of:

passing cooling air from a dead rim cavity to a plurality of cooling air feed holes to provide convection cooling to a suction side of the platform;

passing the cooling air along a leading edge cooling channel and a trailing edge cooling channel to provide convection cooling to a leading edge side and a trailing edge side of the platform;

passing cooling air from the leading edge cooling channel through a first row of cooling channels to provide convection cooling to a forward side of the pressure side of the platform;

passing cooling air from the trailing edge cooling channel through a second row of cooling channels to provide convection cooling to an aft side of the pressure side of the platform; and, discharging the cooling air from the leading edge cooling channel, the trailing edge cooling channel and the two rows of cooling channels on the pressure side of the platform along a pressure side mate face to form a seal.

* * * * *